United States Patent [19]

Fujimoto

[11] 3,939,826

[45] Feb. 24, 1976

[54] ELECTROMOTIVE MASSAGE APPARATUS FOR BEATING AND KNEADING BODY

[76] Inventor: Shinichiro Fujimoto, 6-8 Hannanchounaka, Abeno, Osaka, Japan

[22] Filed: Nov. 7, 1974

[21] Appl. No.: 521,795

[52] U.S. Cl. ..... 128/55

[51] Int. Cl.[2] ..... A61H 23/00

[58] Field of Search ..... 128/55, 54, 52, 51, 57

[56] References Cited

UNITED STATES PATENTS

| | | | |
|---|---|---|---|
| 3,424,149 | 1/1969 | Fujimoto | 128/55 |
| 3,800,785 | 4/1974 | Inada | 128/55 |

*Primary Examiner*—Lawrence W. Trapp

[57] ABSTRACT

An electromotive massage apparatus for beating and kneading body comprises clutch means with a movable gear and pulley blocks in association with said clutch means. Said movable gear which is slidable according to revolution of a motor engages with either of pulley blocks and then transmit said revolution to the gear engaged pulley block. This gear engaged pulley changes said revolution into reciprocating motion by means of eccentric members and further transmit the reciprocating motion to a pair of oscillating yokes. Accordingly, said oscillating yokes which are cooperable with the gear engaged pulley block are oscillated pivotally with respect to axes for pivotal movement, so that vibrators beat and knead body as the motor rotates.

3 Claims, 7 Drawing Figures

ELECTROMOTIVE MASSAGE APPARATUS FOR BEATING AND KNEADING BODY

BACKGROUND OF THE INVENTION

This invention relates to an electromotive massage apparatus and more particularly to vibrators operating means of the massage apparatus to beat and knead body with a single unit as the motor rotates clockwise or counterclockwise.

Massage is used primarily to aid circulation of blood and relieve local pain or muscle spasm. It is usually applied by the hands, although swirling water or mechanical devices may be employed. With tendency of increased rationality and speed with which massage is being used, various types of mechanical devices have been utilized in order to massage efficiently. Generally, the most common strokes on the electromotive massage apparatus are alternatively either of beating or kneading body and therefore it has been impossible to beat and knead body with a single unit. Thus it is always necessary to have an electromotive massage apparatus for beating as well as kneading body in order to increase therapeutic effect and desirable ecconomic advantages.

SUMMARY OF THE INVENTION

An electromotive massage apparatus for beating and kneading body comprises clutch means having a movable gear and pulley blocks in association with said movable gear. Said movable gear to be slid according to revolution of a motor engages with either of pulley blocks and then transmit said revolution to the gear engaged pulley. This gear engaged pulley block changes said revolution into reciprocating motion by means of eccentric members which are mounted with said gear engaged pulley block and further transmit this reciprocating motion to a pair of oscillating yokes which are cooperable with the gear engaged pulley block. When the motor rotates clockwise or counterclockwise, said oscillating yokes oscillate pivotally horizontally and vertically with respect to the pivots so that vibrators may beat and knead body.

Accordingly, an object of the present invention is to overcome the aforementioned disadvantages of prior arts and to provide an improvement which resides in the novel parts and combination of parts.

Another object of the present invention is to effect a secure and speedy change of the vibrators movements by simple switch operation.

A further object of the present invention is to provide the device of the aforesaid type which is simple in construction and inexpensive to manufacture.

Other object and many of the attendent advantages of this invention will be readily appreciated as the same becomes better understood by reference to the following description.

BRIEF DESCRIPTION OF THE DRAWINGS

The accompanying drawings illustrate the preferred embodiment of the present invention. In the drawings, the same reference numerals illustrate the same parts of the invention, in which.

DETAILED DESCRIPTION OF THE INVENTION

Figure 1:
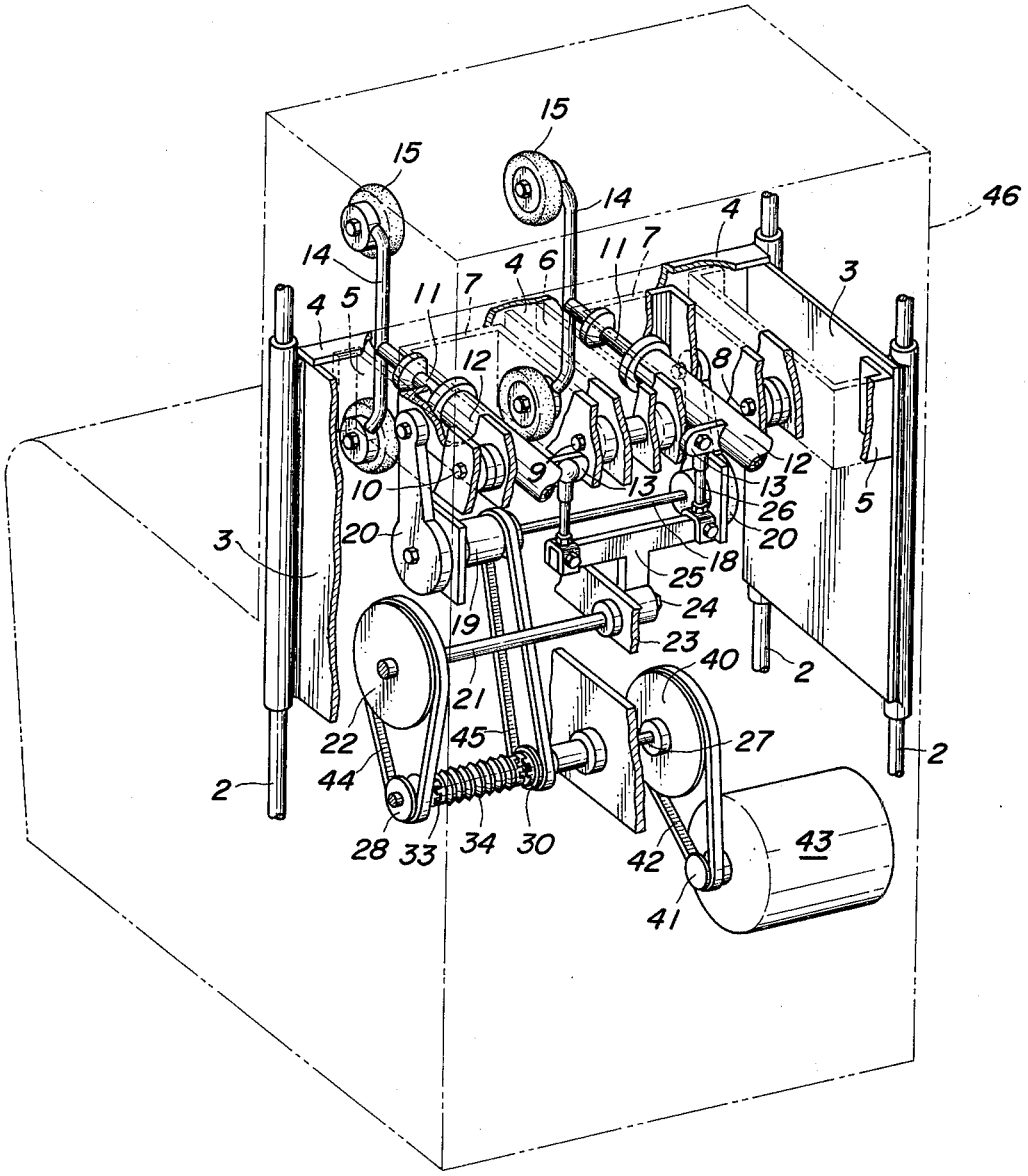
FIG. 1 is a diagrammatic illustration suitable for carrying out several embodiments of the present invention.
Figure 2:
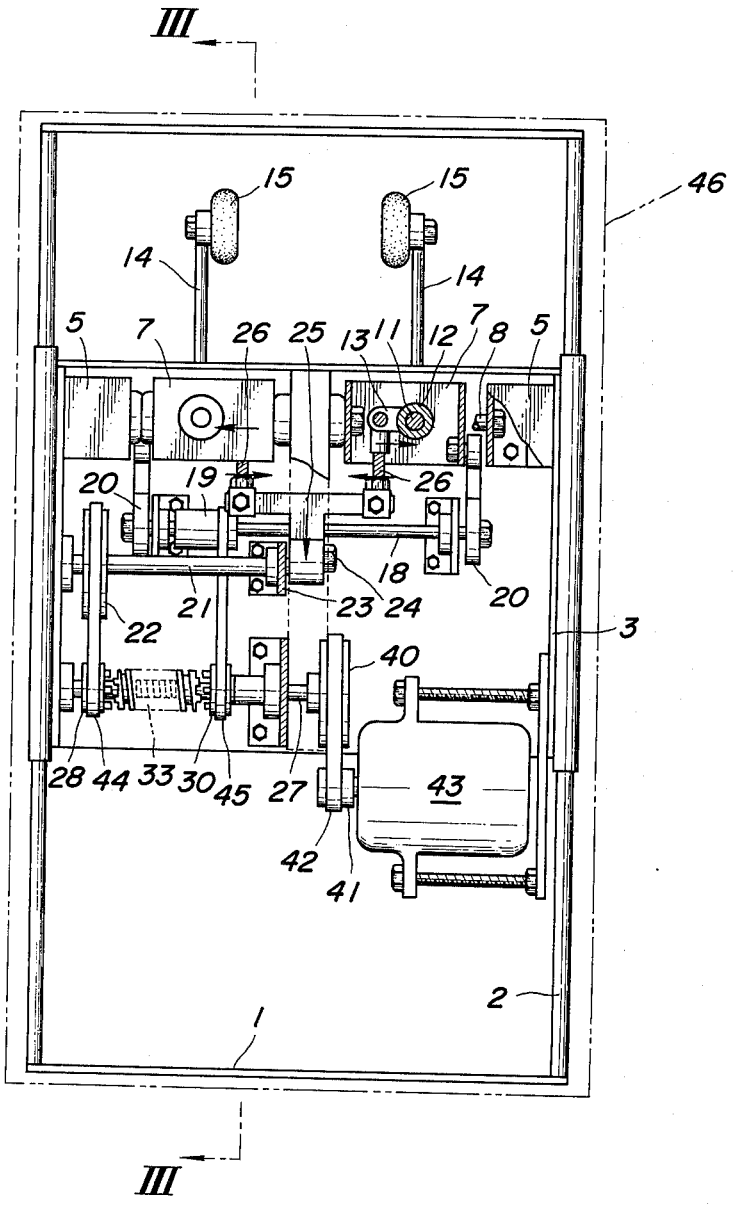
FIG. 2 is a rear elevation and partial cutaway view.
Figure 3:
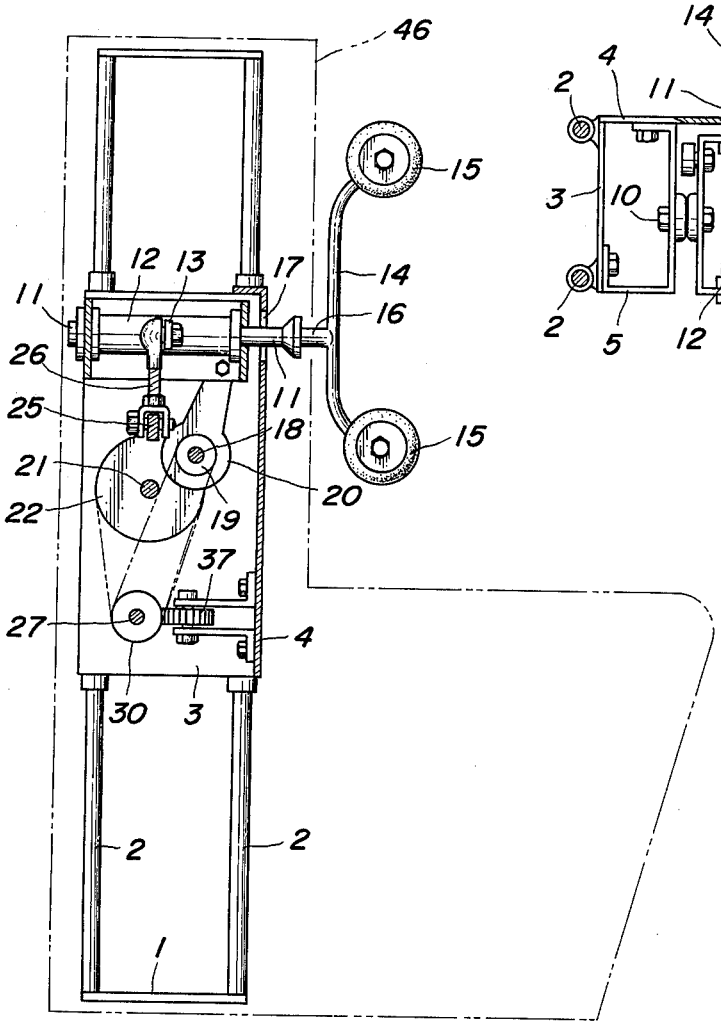
FIG. 3 is a side elevation of the line 3—3 in FIG. 1.
Figure 4:
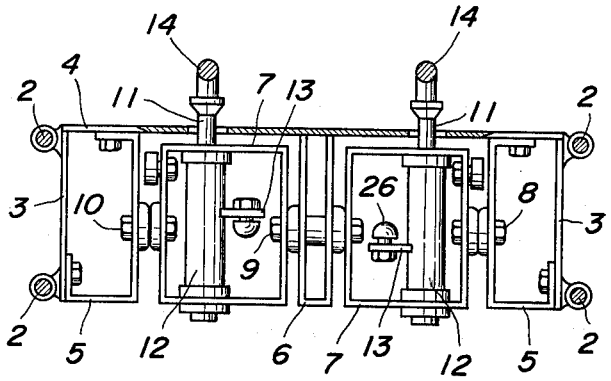
FIG. 4 is a top plane view and partial cutaway view.

Referring to the drawings there is shown according to a preferred embodiment of the invention, four guide columns 2 secured to a base 1. An elevating yoke 3 is mounted with said guide columns for longitudinal movement relative to the base. Support plates 5 are positioned at both upper sides in the elevating yoke and also the other support plate 6 positioned at the upper central portion. A pair of oscillating yokes 7 are pivotally mounted on said support plates assemblies 5, 6 so as to oscillate horizontally and vertically with respect to axes 8, 9, 10 for pivotal movement. Rotary shafts 11 are provided with said oscillating yokes and further is arranged within drum shafts or sleeves 12 fixed in a required position of the yokes 7. There are on the sleeves oval pieces 13 projecting outwardly from sleeve outer surface. Each of spindles 14 have a pair of vibrators 15 of flexible synthetic resin at its both end portions and is further connected at the central portion to each of the outer end portions of the rotary shafts 11 extending outwardly through openings 17 which are formed in a front plate 4 of the elevating yoke.

Figure 6:
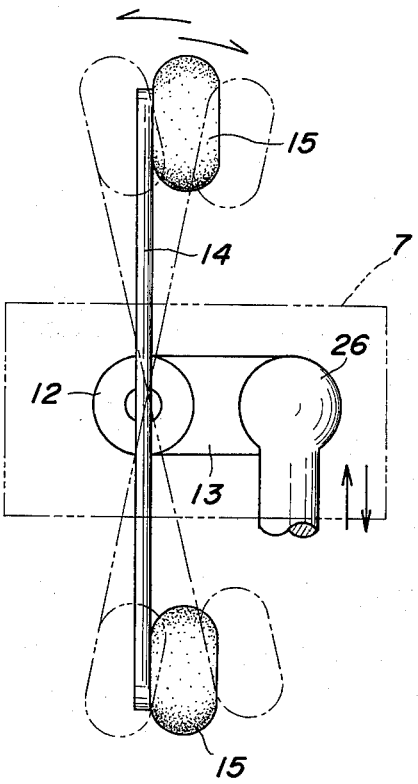
FIGS. 6 and 7 is a diagrammatic illustration of vibrators movement in the sleeve crossed direction and along the axis of the sleeve.
Figure 7:
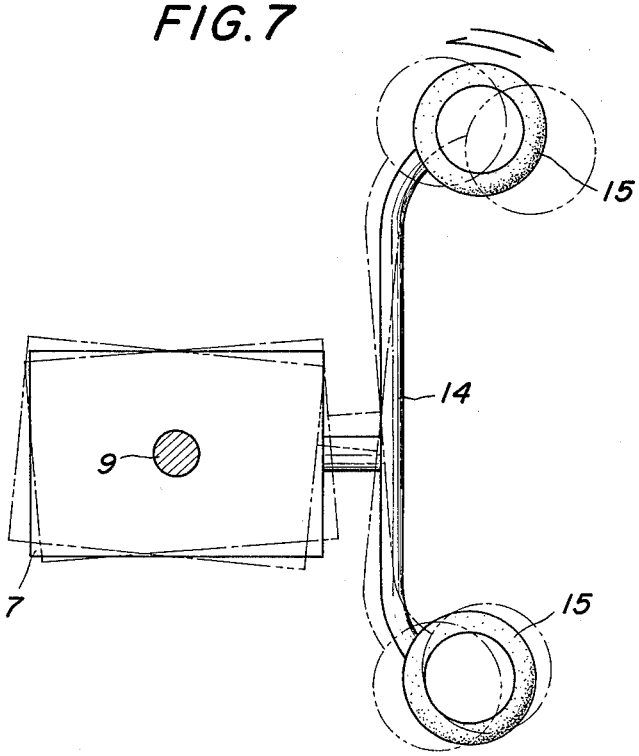

Down the oscillating yokes in the elevating yoke, there is provided a first power transmission shaft 18 on which a pulley 19 of a second lever means is journalled at the central portion and also outer eccentrics operably connected to the oscillating yokes are mounted at its both end portions. When the first transmission shaft rotates, the oscillating yokes 7 are oscillated pivotally vertically during eccentric pitch with respect to the pivots 8, 9, 10 by means of the outer eccentrics, so that vibrators 15 move along the axis of sleeve as shown in FIG. 7. At the backside of and down the first transmission shaft, there is a second power transmission first lever means such as shaft 21 on which a pulley 22 is journalled at one end portion and a eccentric rod 24 is mounted at the other end portion to be operably connected to the oscillating yokes through a T-shaped steel connector 25. Connector rods 26 are connected to each of the horizontal upper end portions of said steel connector and is further connected at the other end portion to each of projecting pieces 13 of the sleeves. On rotating of the second transmission shaft, the oscillating yokes are oscillated pivotally horizontally in the same manner as above so that the vibrators 15 move in the sleeve crossed direction as shown in FIG. 6.

A secondary shaft 27 of the motor is provided down the second transmission shaft and at the central portion of the secondary shaft 27, a racing pulley 30 with toothed engaging portions 31 on its inner surface is journalled in opposition to the pulley 19 of the first transmission shaft of the second lever means, and the other racing pulley 28 with inner toothed engaging portions 29 is journalled at its one end portion distant from the motor in opposition to the pulley 22 of the second transmission shaft. On a generally square shaft 32 is axially journalled a movable gear 33, through the full length of which gear teeth 34 are longitudinally threaded. Toothed engaging portions 35, 36 are respectively mounted on both end portions of the movable gear so as to engage with said engaging portions 29, 31 of the opposite racing pulleys. It is within the scope of the present invention to provide an anti-racing assembly which includes a lever selector means such as ratchet 37 engaging with the gear teeth 34 of the slidable gear and biasing means to prevent racing of the ratchet 37. Said ratchet with gear teeth 38 is positioned to securely rotate the movable gear according to revolution of the secondary shaft and further to slide the gear in the direction of progress. Accordingly, the movable gear can engage with either of the opposite racing pulleys to transmit power to the gear engaged pulley block.

Figure 5:
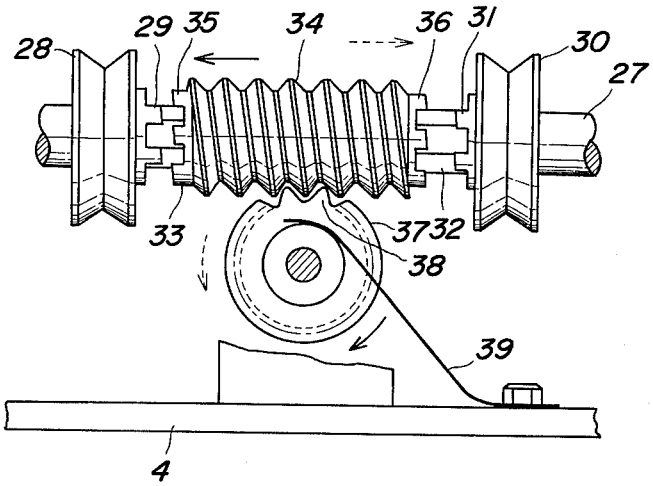
FIG. 5 is a greatly enlarged detail view of a movable gear.

It is to be noted that, in FIG. 5, the movable gear 33 also rotates clockwise according to clockwise rotation of the secondary shaft 27 and the availability of said rotation enables the gear to slide in a left direction as shown in solid line's arrow, whereby the gear can rotate the pulley 28 after engaging with this pulley. When the secondary shaft rotates counterclockwise, the gear enables the pulley 30 of the second lever means in the same manner as described above. At one end portion of the secondary shaft adjacent the motor is journalled a pulley transmitting power from a primary shaft 41 of the motor. In the attached drawings, the numeral 43 indicates a small size motor, the numeral 44 indicate each of belts of the first lever means and 45 of the second lever means, and the numeral 46 indicates a housing. By reason of such construction, a complete rectilineal motion of the movable gear can be obtained and we can therefore effect a secure and speedy change of the vibrators movements, i.e., a beating and kneading body.

In operation, when the secondary shaft rotates clockwise according to clockwise revolution of the motor by switch operation, the movable gear enables the second transmission shaft to rotate through the belt 44 and the pulley 22 after engaging with the racing pulley 28. Said revolution on the second transmission shaft is changed into reciprocating motion by the eccentric rod and hereafter said reciprocating motion is transmitted to each of the oscillating yokes through the T-shaped steel connector and the connector rods. Furthermore, the availability of said reciprocating motion enables the oscillating yokes to oscillate pivotally horizontally during eccentric pitch with respect to the pivots and thereby can move the vibrators in the sleeve crossed direction so as to knead body. On the other hand, when the secondary shaft rotates counterclockwise, the movable gear enables the first transmission shaft in the same manner as above, so that the vibrators can move along the axis of sleeve to beat body.

The invention may be embodied in other specific forms without departing from its spirit or essential characteristics. The described embodiment is to be considered in all respects only as illustrative and not respective and the scope of the invention is, therefore, indicated by the appendant claims rather than by the foregoing description. All changes which come within the meaning and range of equivalency of the claims are to be amended within their scope.

I claim:

1. An electromotive massage device comprising in combination: an electrically-driven power means for driving a shaft rotatably; first drive shaft means including a first drive shaft adapted to be driven by the electrically-driven power means, and a second drive shaft spaced axially from the first drive shaft, and a third drive shaft mounted as a tubular shaft coaxially around and separately rotatably from the first drive means; and a tubular gear means providing a tubular gear slidably shiftable axially to and fro for shifting driving torque alternately between engagement with the second drive shaft and the third drive shaft providing for alternate driving of the second and third drive shafts selectively intermittently as desired; lever selector means for selectively moving the tubular gear means in either of to and fro axially engageable directions for alternate driving of the second and third drive shafts; a massage means providing for alternate use as a massager and a tapping device, including a pivotably mounted shaft element and a mounting base therefor; a first lever means for drivably interconnecting said pivotably mounted element and one of the second drive shaft and the third drive shaft and including a first eccentric cam mounted to impart reciprocatable upright motion to said pivotably mounted element; and a second lever means drivably interconnected to the remaining one of the second drive shaft and the third drive shaft and including a second eccentric cam mounted to impart reciprocatable upright motion to the massage means, and a tapping element axially reciprocatably mounted and adapted for horizontal movement on the mounting base and drivably connected to said second lever; such that the pivotably mounted element is movable pivotably uprightly intermittently selectively and alternately said tapping element is reciprocatable axially horizontally intermittently selectively.

2. An electromotive massage device of claim 1, in which the massaging means further includes vibrator means mounted on a distal end of the tapping element, the vibrator means being for imparting vibrating percussions to a persons body, the pivotably mounted shaft element being mounted on said mounting base and adapted to be reciprocated axially by rotary motion of said first eccentric cam when the first lever is drivably engaged with the tubular gear means.

3. An electromotive massage device of claim 2, in which the tubular gear means includes an outer cylindrical female threaded surface, and said lever selector means includes male engaging elements for meshing with the female threaded surface, adapted such that selectively clockwise or counter clockwise motion may be alternately imparted to the tubular gear means whereby alternately one or the other of the first and second eccentric cam are drivable rotatably.

* * * * *